US005186820A

United States Patent [19]

Schultz et al.

[11] Patent Number: 5,186,820

[45] Date of Patent: Feb. 16, 1993

[54] PROCESS FOR SEPARATING BITUMEN FROM TAR SANDS

[75] Inventors: Clifford W. Schultz; G. Daniel Irvin, both of Tuscaloosa, Ala.

[73] Assignee: University of Alabama, Tuscaloosa, Ala.

[21] Appl. No.: 802,186

[22] Filed: Dec. 4, 1991

[51] Int. Cl.[5] ..... B03D 1/02; C10G 1/00; C10G 1/04

[52] U.S. Cl. ..... 209/164; 209/158; 208/390; 208/391; 208/425; 208/426; 241/16; 241/20; 241/22; 241/24

[58] Field of Search ..... 209/3, 158, 164; 208/390, 391, 425, 426; 241/20, 21, 22, 23, 24, 16

[56] References Cited

U.S. PATENT DOCUMENTS

| | | | |
|---|---|---|---|
| 3,041,267 | 6/1962 | Frame | 208/425 |
| 3,271,293 | 5/1963 | Clark | 208/391 |
| 3,931,006 | 1/1976 | Baillie | 208/391 |
| 3,963,599 | 6/1976 | Daritt | 208/391 |
| 3,969,220 | 7/1976 | Anderson | 208/391 |
| 4,018,665 | 4/1977 | Anderson | 208/391 |
| 4,094,768 | 6/1978 | Fuller | 208/391 |
| 4,110,195 | 8/1978 | Harding | 208/391 |
| 4,120,776 | 10/1978 | Miller | 208/391 |
| 4,406,793 | 9/1983 | Kruyer | 208/390 |
| 4,409,090 | 10/1983 | Hanson | 208/391 |
| 4,425,227 | 1/1984 | Smith | 208/391 |
| 4,533,459 | 8/1985 | Dente | 208/391 |
| 4,545,892 | 10/1985 | Cymbalisty | 208/391 |
| 4,946,597 | 8/1990 | Sury | 208/425 |
| 5,066,388 | 11/1991 | Ross | 208/425 |

OTHER PUBLICATIONS

*New Aspects of Water-Based Physical Separation Processes for Domestic Tar Sands,* Miller, J. D. et al, 1985 Eastern Oil Shale Symposium, Nov. 18-20; 1985.

*Concentration of Utah Tar Sands by an Ambient Temperature Flotation Process,* Miller, J. D. et al, International Journal of Mineral Processing, 9 (1982) 269-287.

*Primary Examiner*—Peter Hruskoci
*Assistant Examiner*—Thomas M. Lithgow
*Attorney, Agent, or Firm*—Oblon, Spivak, McClelland, Maier & Neustadt

[57] ABSTRACT

A process for separating bitumen from tar sands, which comprises: a) agitating a mixture of tar sand with substantially coarse clean sand at ambient or below ambient temperature in the presence of water, so as to mechanically shear bitumen and enhance the detachment of bitumen particles from mineral matter in said tar sand, b) eluting the detached bitumen and fine mineral matter from the coarse sand by an upward flow of water while stirring gently, c) returning the coarse sand to step a) for reuse, and d) subjecting the eluted bitumen and fine mineral matter to froth flotation to separate the bitumen from said fine mineral matter, wherein the flotation is effected without using any reagents.

10 Claims, 7 Drawing Sheets

PROCESS FOR SEPARATING BITUMEN FROM TAR SANDS

BACKGROUND OF THE INVENTION

1. Field of the Invention

The present invention relates to a process for separating bitumen from tar sands and, in particular, to a process for separating relatively high viscosity bitumen from tar sands.

2. Description of the Background

Tar sand is a mixture of bitumen (tar) and sand. The bitumen content varies from deposit to deposit as well as within a given deposit. Tar sand deposits occur throughout the world, frequently in the same geographical area as conventional petroleum deposits. It has been estimated that about two-thirds of all of the known oil in the world is contained in tar sand deposits or in heavy oil deposits. In particular, large tar sand deposits have been identified and mapped in Canada, Venezuela and the United States.

Canadian tar sands represent one of the largest deposits in the world, having an estimated recoverable potential of approximately 900 million barrels. In the United States, although tar sand deposits have been reported in at least twenty two states, the largest and most significant deposits are found primarily eleven states: Alabama, Alaska, California, Kansas, Kentucky, Missouri, New Mexico, Oklahoma, Texas, Utah and Wyoming.

In Alabama, the most significant asphalt or tar sand deposits occur in the Pride Mountain formation and overlying Hartselle Sandstone. Past commercial development has been restricted largely to the provision of material for road construction and has been conducted primarily in Pride Mountain deposits in west-central Colbert County. The widespread Hartselle Sandstone, however, contains the largest reserves of petroleum and these rocks are considered to have the best potential for future oil-extraction operations. The bitumens in these rocks is characterized primarily as a typical asphalt containing hydrocarbons that have been variably biodegraded.

Further, core analyses show that the Hartselle Sandstone has widely variable porosities, permeabilities and oil saturations. Porosities of bitumen—impregnated intervals range from less than 5% to as much as 24%, and permeabilities range from less than 10 millidarcies to hundreds of millidarcies. Oil saturations range from only a trace to zones containing in excess of 700 barrels per acre-foot. Some localized areas contain in excess of 12,000 barrels of bitumen per acre. Reserves in the outcrop area are estimated to be approximately 350 million barrels at depths shallower than 50 feet, and some 7.5 billion barrels are thought to be present in the subsurface within an area of fifty square miles.

Throughout the past fifty years, various processing strategies for tar sands have been tested. Due to the significant differences in the physical and chemical nature of Utah or Alabama tar sands as compared to Canadian tar sands and because of the great differences in climatic conditions between the two locations, however, the technology developed for Canadian tar sands cannot be directly applied to Utah tar sands. An example of a process that has been developed specifically for Utah or Alabama tar sands is set forth in U.S. Pat. No. 4,120,776. This process is, in essence, a hot water process wherein a hot, aqueous solution having a controlled pH range is used to displace the bitumen from the sand.

While relatively good separation of the bitumen from the tar sand has been obtained using variations in the hot water separation process, any hot water processing methodology necessarily requires substantial energy input. For example, it has been estimated that the required energy input for digestion in the hot water process, operating at 95° C. and obtaining about 90% bitumen recovery, requires at least 45 kilowatt hours of energy per ton of tar sand processed.

More recently, in an attempt to reduce energy consumption and to recover bitumen from tar sands at ambient temperature, Miller et al, U.S. Pat. No. 4,486,294, disclose a process for recovering bitumen from tar sand, which entails, in essence: grinding the tar sand to mechanically fracture the bitumen and thereby disengage bitumen particles from sand particles, mixing a wetting agent with the tar sand during grinding to disengage bitumen particles from the sand particles, conditioning the bitumen particles with an oil to enhance the hydrophobicity of the bitumen particles, and separating the bitumen particles from the sand particles by flotation. U.S. Pat. No. 4,486,294 uses conventional grinding techniques.

However, while a reduced energy consumption is maintained with the above method, grinding or comminution achieves only limited success in effecting a phase disengagement in tar sands. Further, it has been determined that if grinding or comminution is carried on for too long a time the process of disengagement is actually reversed and the quality of separation is reduced.

Thus, a need exists for a process for separating bitumen from tar sands reduced energy requirement, while obtaining a good yield of bitumen in effecting separation.

SUMMARY OF THE INVENTION

Accordingly, it is an object of the present invention to provide a process for efficiently separating bitumen from tar sands.

It is also an object of the present invention to provide a process for effecting an efficient separation of bitumen from tar sands with a low energy requirement.

It is also an object of the present invention to provide a process for separating bitumen from tar sands such that a good yield of bitumen is obtained.

The above object and others are provided by a process for recovering bitumen from tar sand, which comprises:

a) agitating a mixture of tar sand with substantially clean sand at ambient or below ambient temperature in the presence of water, so as to mechanically shear bitumen and enhance the detachment of bitumen particles from mineral matter in said tar sand, b) eluting the detached bitumen and fine mineral matter from the coarse sand by an upward flow of water while stirring gently, c) returning the coarse sand to step a) for reuse, and d) separating the bitumen from the fine mineral matter by froth flotation, wherein the flotation is effected without using any reagents.

BRIEF DESCRIPTION OF THE DRAWINGS

FIG. 5(*b*) is a schematic illustration of a bitumen coated sand grain after fragmentation.

DETAILED DESCRIPTION OF THE PREFERRED EMBODIMENTS

Figure 1:
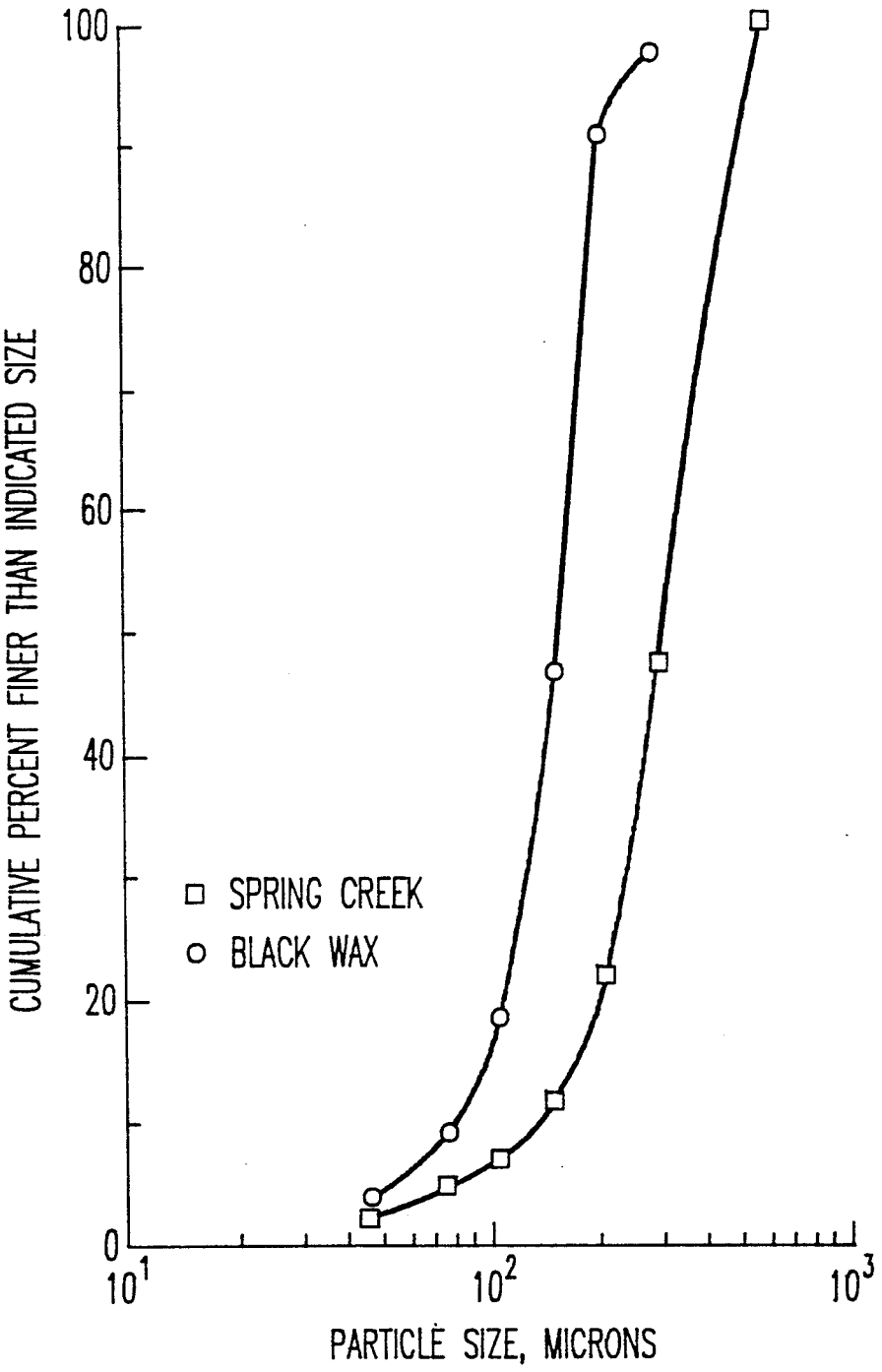
FIG. 1 illustrates a size analysis of Alabama tar sand head sample extracted sands.

In accordance with the present invention, a process is provided for separating bitumen from tar sands. More particularly, in accordance with the present process, bitumen is recovered from tar sands in excellent yield and with a reduced energy input. Furthermore the recovered bitumen is cleaner as it contains less residual mineral matter, for example, than is obtained using conventional processes.

Generally, the present process entails a) agitating or scrubbing a mixture of tar sand with substantially clean sand at ambient or below ambient temperature in the presence of water so as to mechanically shear bitumen and enhance the detachment of bitumen particles from mineral matter, b) eluting the detached bitumen and fine mineral matter from the coarse sand by an upward flow of water while stirring gently, c) returning the coarse sand to step a) for reuse, and d) separating the bitumen from the fine mineral matter by froth flotation, wherein the flotation is effected without using an reagents.

In accordance with the first step of the present process, a tar sand sample is broken to a size distribution approximating that of the mineral matter contained in the tar sand and is then mixed with substantially clean sand, which may be of about the same size or a of a somewhat coarser size distribution. Generally, the amount of clean sand should be greater than the amount of tar sand used. The mixture is then agitated, or scrubbed, in the presence of water for several minutes at a high ratio of solids to water and a high rate of shear. Sodium silicate or sodium hydroxide may be added to the solid-water slurry prior to scrubbing as agitating agents, for example. During agitation or scrubbing the slurry is maintained at ambient or below ambient temperature.

In general, the tar sand sample is broken, prior to mixing with clean sand, to a size distribution such that the native sand grains are detached from each other but remain essentially unbroken. Further, the clean sand may be about the same size or of a somewhat larger size distribution than the size distribution of the broken tar sand sample. However, the clean sand need not necessarily be coarser as the native sand, after being cleaned, can be used to scrub new tar sand.

Moreover, the agitation or scrubbing may be performed in any suitable agitating or scrubbing means. For example, a Denver laboratory conditioner may be used. Generally, such a device entails two opposed impellors, i.e., the upper blade forces the slurry downward while the lower impellor blade forces the slurry upward, mounted on a single rotating shaft. Further, the agitation is performed in the range of about 1,500 to 3,000 rpm. However, speeds in the range of about 2,700 to 3,000 rpm are preferred.

Generally, in step a) the bitumen concentrate contains mineral matter such as clays or fine silica in a total amount of about 50% by weight.

Generally, the sand used is very clean. As used herein, the term "substantially clean sand" means that the sand used contains at least about 95% of $SiO_2$, preferably at least about 97% $SiO_2$ by weight. For example, sand may be used which contains up to about 5% residual bitumen, preferably up to about 3% residual bitumen, by weight. Preferably, only about 1% to 2% by weight of residual bitumen or less is contained in the sand.

Moreover, in general grain sizes coarser than about 100 mesh are used in accordance with the present invention. However, it is generally preferred to use grain sizes in the range of about 28 to 48 mesh.

In accordance with the present invention, however, it is most preferred to use a very clean sand, such as Ottawa sand. This sand is a glass quality sand which is typically 99+% by weight $SiO_2$ and closely sized (−28+48) mesh.

Moreover, any hard mineral may be used instead of sand ($SiO_2$) provided that the above noted grain sizes are maintained. However, the hard minerals generally used in place of quartz sand are zircon, garnet, olivine, feldspar, corundum or ceramics, such as alumina or silicon carbide. Fines such as clays may not be used.

Notably, of all of the hard minerals mentioned above, quartz is the least expensive and is replaced by quartz grains from the tar sand as they are freed of bitumen. Thus after an initial ration of exogenous sand, new clean sand is generated by the process.

Furthermore, in the present process, sand contained in the tar sand can be recycled to the scrubbing step after it is cleaned. That sand may contain as much as 5% by weight, preferably 3% by weight, more preferably 1 to 2% by weight or less of residual bitumen. When recycling sand to step a) there is a tendency to build up a surplus of sand. The surplus can be bled out of the circuit by screening out the finer fractions, i.e., at approximately 65 mesh.

The agitation or scrubbing step of the present process is generally effected at ambient temperature or below. Generally, it is preferred to effect this step at a temperature below about 25° C. This step may result in the generation of heat with a consequent rise in water temperature. If necessary, this step may be conducted with a cooling means, such as a fluid bath or jacket on the scrubbing or agitating vessel. For example, a conventional water bath or an oil bath may be used as a cooling means.

Generally, the scrubbing or agitation step may be conducted in any liquid which is capable of floating bitumen thereon, however, it is preferred that water be used. Further, a dispersant may be added to the water, such as sodium silicate or sodium hydroxide, for example. Other dispersants, i.e., agitating agents, known to those skilled in the art may also be used.

In step b) of the present process, the elution flow velocity used is generally sufficient to cause an upward movement of the detached bitumen fragments but less than would cause upward motion of the sand grains. As a general matter, a flow of less than about 1.25 cm/sec and greater than about 0.075 cm/sec, and preferably less than about 1.0 cm/sec and greater than about 0.1 cm/sec, or the conditions approximated by a mechanical classifier.

After scrubbing, the slurry obtained is generally diluted to a low solids concentration and allowed to settle for a brief period. After settling, the remaining suspended solids (slimes) are removed by decanting the slurry. The slurry is again diluted with water to approximately 5 to 20% solids by weight, preferably about 7 to 20% solids by weight.

The present invention may thus be characterized by the combination of the following important aspects: the use of substantially clean sand to enhance the detachment of bitumen during agitation or scrubbing, agitating or scrubbing at ambient or below ambient temperature and primary flotation without the use of collectors or frothers. Also, secondary removal of mineral matter by stirring and settling in a quiescent bath may be used, if necessary.

In accordance with the present invention it has been discovered that if conventional grinding or comminution of tar sands is effected for too long a time, the disengagement of bitumen from mineral matter in the tar sand is actually reversed and the extent of separation is reduced. It has also now been discovered that the grade of bitumen concentrate recovered by flotation can be surprisingly increased by the use of limited grinding to expose clean quartz surfaces followed by high intensity attrition scrubbing. Moreover, it has also been discovered that the presence of substantially clean sand (quartz) as described above during scrubbing is an essential factor in achieving phase disengagement.

The flotation step d) of the present process is generally effected by placing the diluted bitumen-fine mineral matter mixture in a flotation cell and the mixture is agitated with the air valve open, so as to collect a bitumen-rich froth. Fine mineral matter is retained in the cell. In accordance with the present invention, any means or device may be used in which air bubbles can be generated by mechanical or pneumatic means may be used. Such flotation cells ar known to the artisan.

Importantly, the present process effects separation of the bitumen from the fine mineral matter by froth flotation without using any reagents. Bitumen is naturally floatable, therefore, a collector is unnecessary. Further, the avoidance of frothing reagents is advantageous inasmuch as a frother of frothing agents tend to increase the froth volume and thereby more fine mineral matter is carried into the froth. Thus, by effecting separation of bitumen from the fine mineral matter without reagents a cleaner product is obtained.

The present invention will now be further illustrated by reference to certain examples which are provided solely for purposes of illustration and are not intended to be limitative.

The tar sands utilized in the following examples were obtained from the Hartselle sandstone formation which is widespread throughout north central to north western Alabama. Samples of the Hartselle formation were taken from sites known as Spring Creek in Colbert Country and Black Wax Hill in Lawrence County.

Petrographic examination of these samples has found them to be fine to medium grained, texturally mature quartz arenites. Intergranular porosity of the sandstones is typically about 18% with approximately two thirds of the pore volume filled by bitumens. Dean-Starke extractions indicated bitumen contents averaging 8.5% by weight.

Model analysis of thin sections of the tar sand samples indicated that the mineral matter was predominately monocrystalline quartz. Minor quantities of polycrystalline quartz were also observed. "Other" minerals, totaling approximately 1.0% of the sample were clays, feldspars and chirt.

Size distribution of sands extracted from the two samples were presented in FIG. 1. Mean particle size of the Spring Creek and Black Wax Hill samples were, respectively, 300 and 150 microns.

Figure 2:
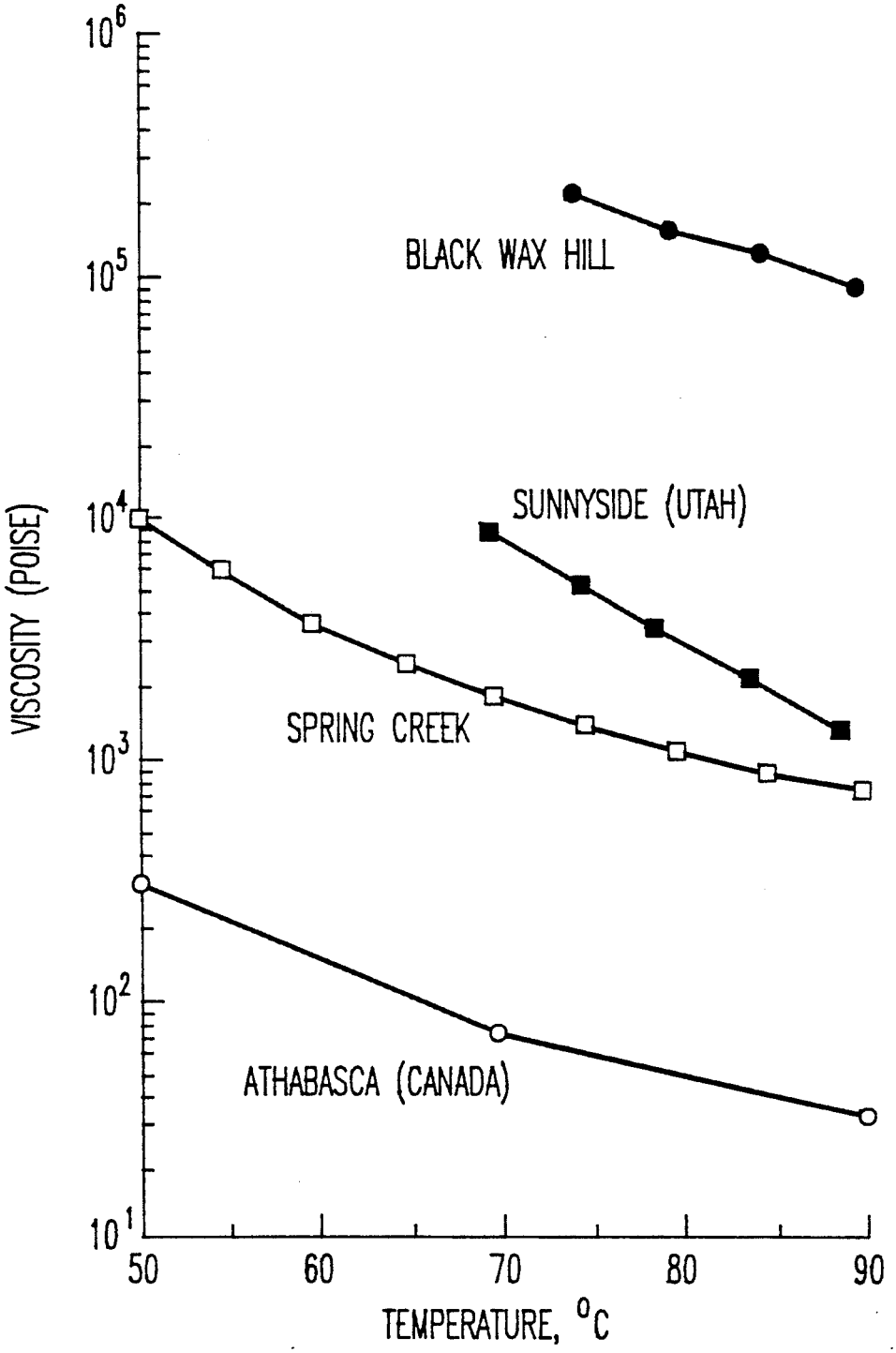
FIG. 2 illustrates a comparison of tar sands viscosities from various sources.

The viscosities of the bitumens extracted from the Black Wax Hill and Spring Creek samples are presented in FIG. 2. Also presented are published data on the Sunnyside (Utah) and Athabasca (Canada) tars.

EXAMPLE 1

Figure 3:
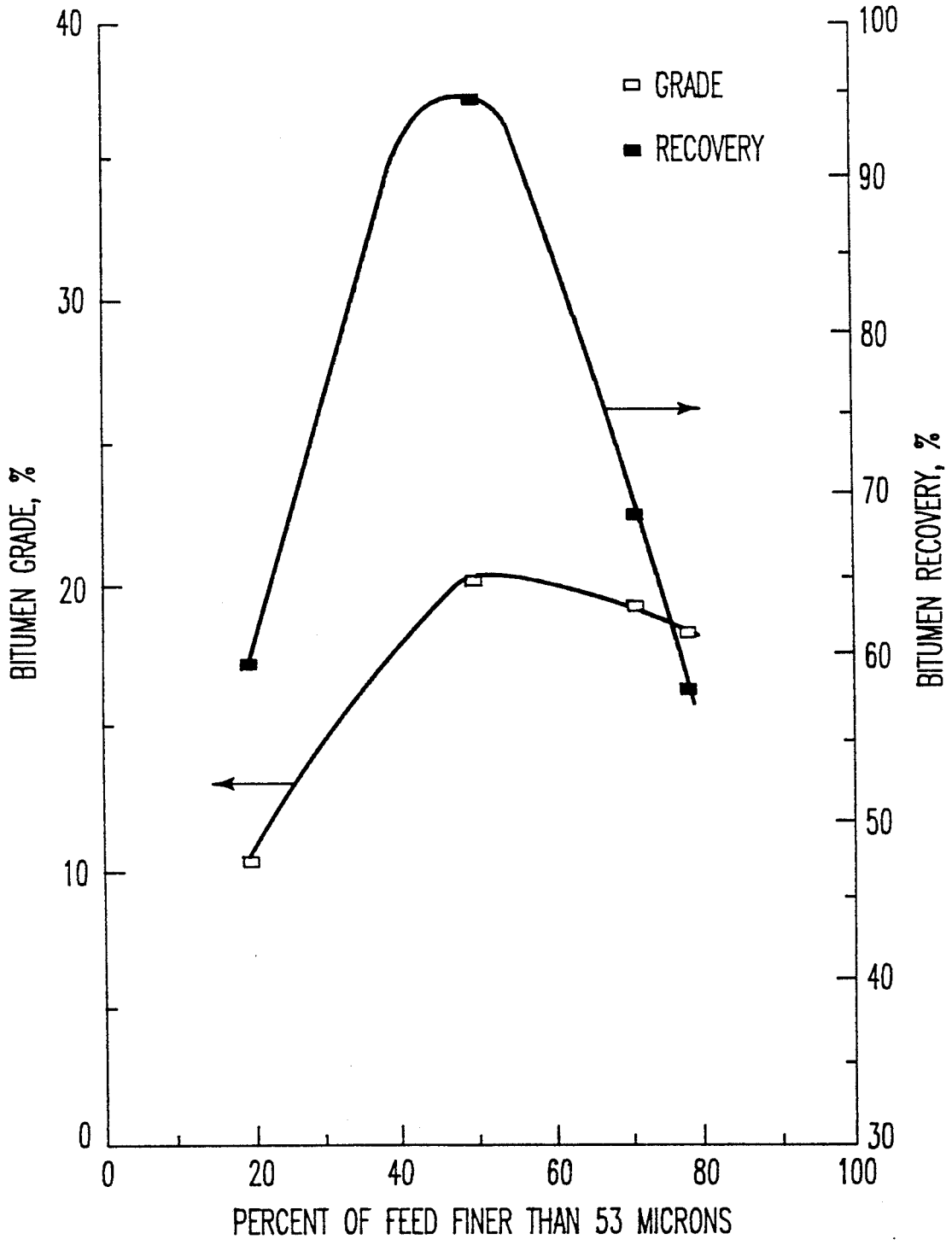
FIG. 3 illustrates the effect of feed size on flotation of Spring Creek tar sand.

The initial benefication tests performed on the Alabama tar sands approximated the approach of Miller et al. Samples of crushed tar sand were ground in a laboratory rod mill then floated in a Denver laboratory flotation cell. The results of a series of tests, in which the grinding time was varied from 5 to 60 minutes, are shown in FIG. 3. Both the grade of concentrate and the recovery of bitumen show maximum values where the blotation feed size is about 50 percent finer than 53 microns. This feed size represents a thirty minute grinding time. These data indicate that excessive grinding may reverse the process of liberation or disengagement of bitumen from its associated mineral matter.

EXAMPLE 2

Figure 4:
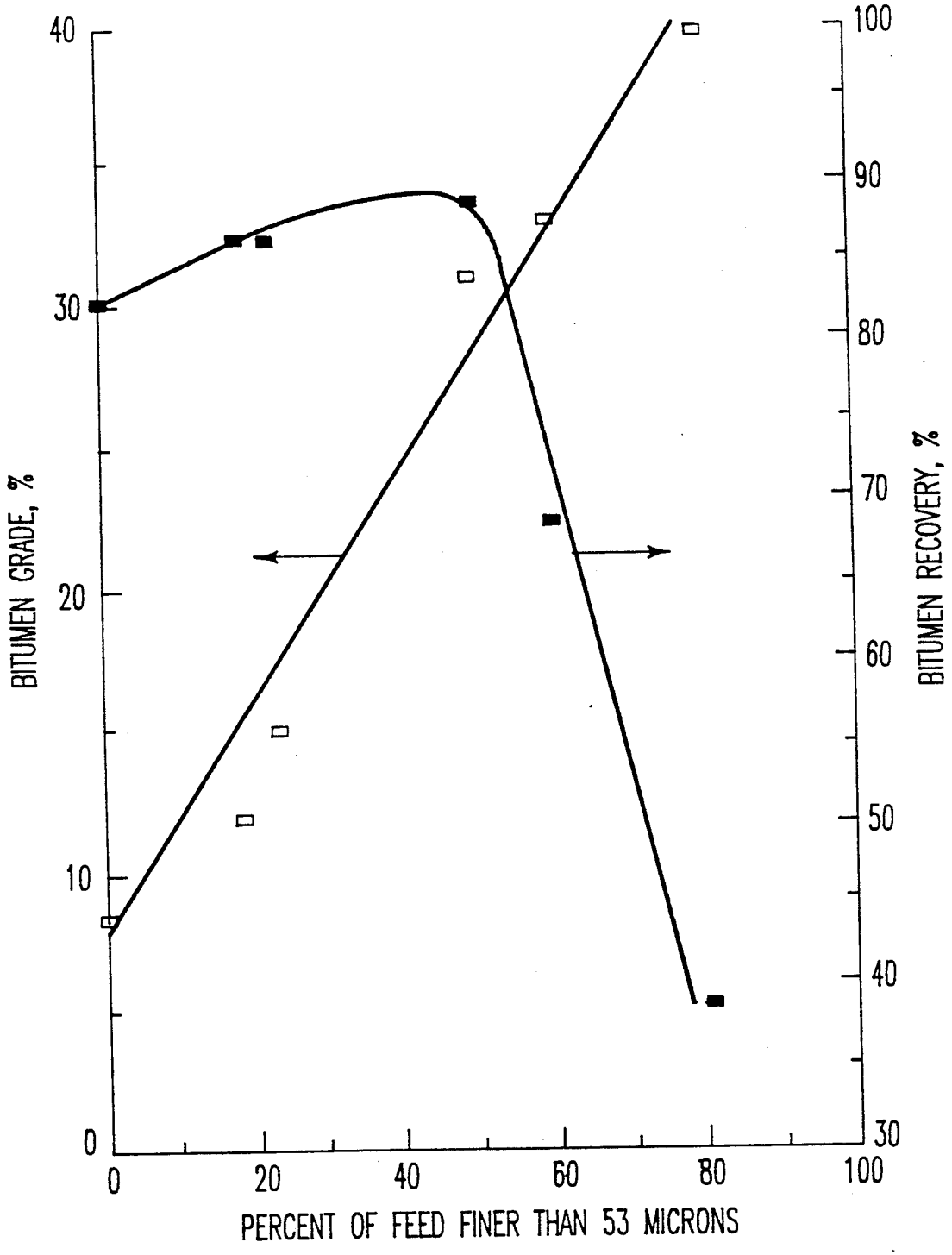
FIG. 4 illustrates the effect of feed size on tar sand flotation.
Figure 5A:
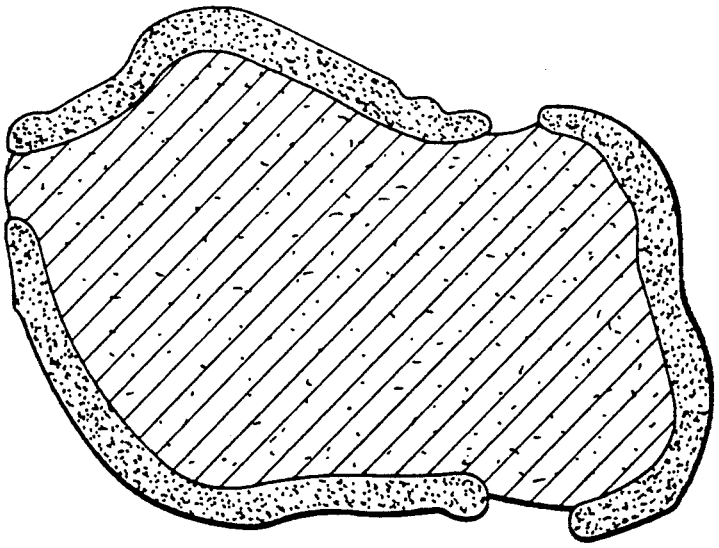
FIG. 5(*a*) is a schematic illustration of a bitumen coated sand grain.
Figure 5B:
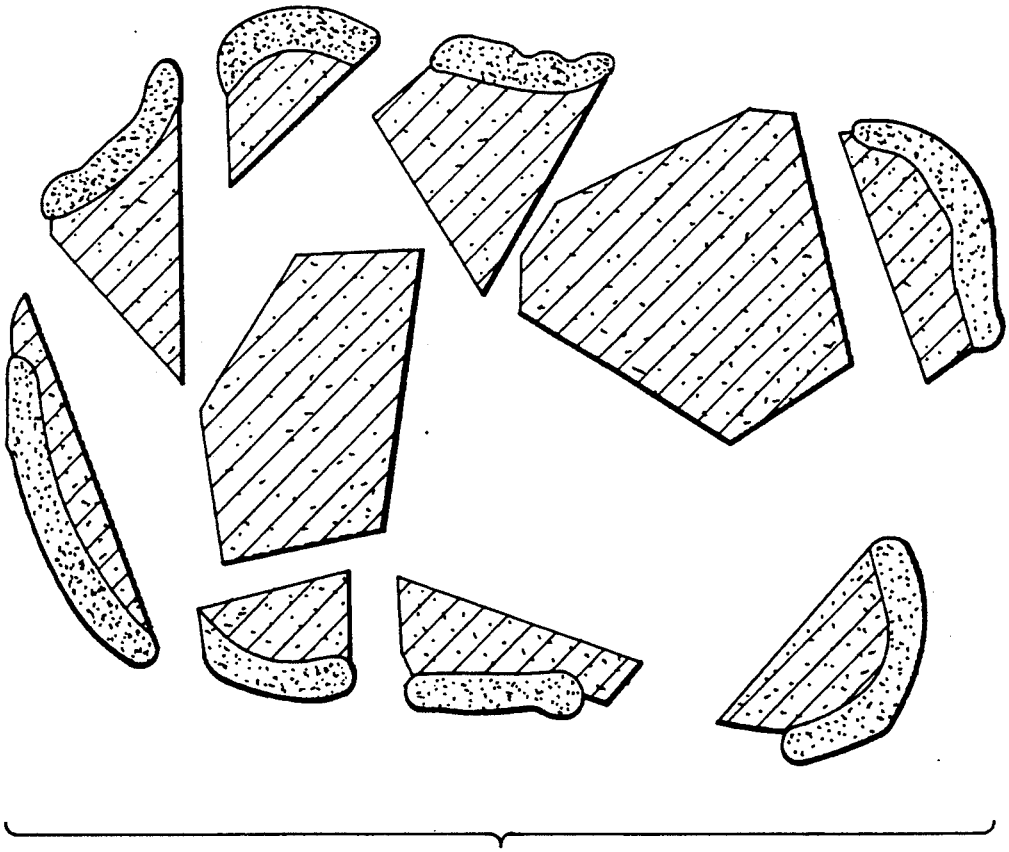

A series of tests were then performed in which the ground samples were subjected to a 15 minute high attrition scrubbing prior to flotation. The results of that series of tests are shown in FIG. 4. The results indicate that simple grinding or comminution is ineffective in achieving liberation and that shearing forces are required to effect detachment of bitumen from the matrix sand grains.

Notably, the grade of bitumen concentrate continued to increase over the entire range of test conditions (grinding times). The recovery of bitumen, however, did show the detrimental effect of over grinding.

An optimum combination of concentrate grade and bitumen recovery again occurred at a condition corresponding to a 30 minute grinding time. Those optimum conditions, however, were substantially better than had been observed and clearly establish the beneficial effect of high attrition scrubbing. Thus, both grinding and attrition scrubbing are necessary in order to achieve a satisfactory bitumen liberation.

EXAMPLE 3

The following example illustrates the importance of using substantially clean sand for agitation or scrubbing.

Crushed samples (−3 mesh) were ground for a period of 5 minutes in a laboratory rod mill. Observation of the products indicated that this level of grinding was adequate to disaggregate the tar sand without fracture and individual sand grains.

The disaggregated tar sand was filtered and mixed with clear Ottawa sand at a ratio of one part tar sand and three parts clean sand. The Ottawa sand is a product sold commercially as No. 4.0 flint shot, and is virtually all −20+28 mesh. The mixed sands were diluted with water to approximately 75% solids. The sand-water slurry was scrubbed for a period of 30 minutes in a Denver laboratory condition or operated in the 2700 rpm.

In early tests a significant temperature rise was noted during the scrubbing operation. The temperature rise softened the bitumen and prevented its effective detachment from the native sand grains. Thereafter, the practice of cooling the scrubbing vessel with ice water was adopted.

The scrubbed slurry was transferred to a Denver laboratory flotation cell and diluted to a volume of approximately 4 liters. After a short settling period, the diluted pulp was deslimed then repulped to a volume adequate for flotation.

Flotation was conducted without the addition of either a froth or a collector. Initial flotation was very rapid and the total froth collection time was approximately 3 minutes. The collected froth was poured into a large beaker of clean water and stirred gently. During storing, clean sand grains could be seen dropping out of the froth and settling to the bottom of the beaker.

Figure 6:
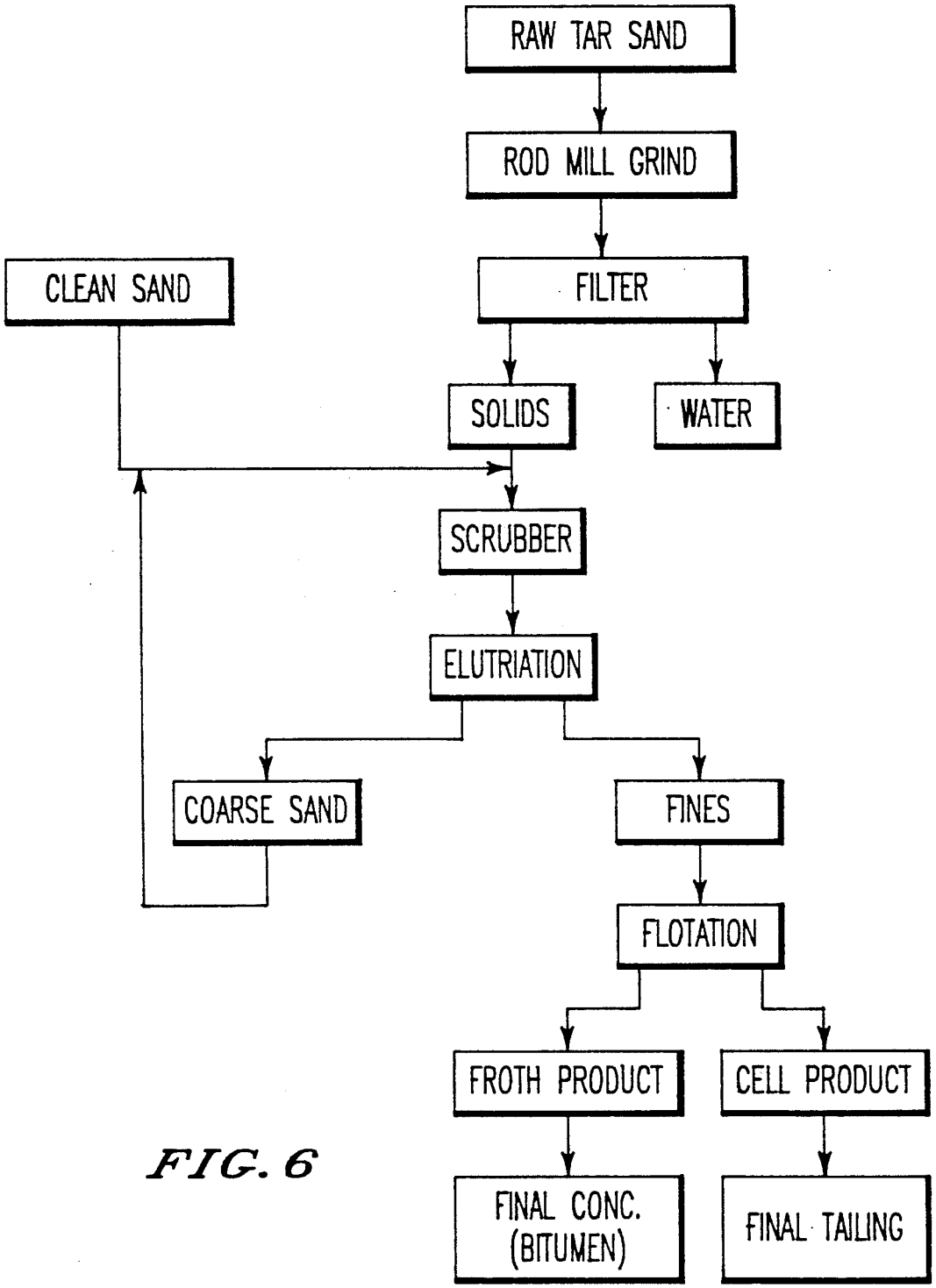
FIG. 6 represents a flow sheet for an embodiment of the present process.
Figure 7:
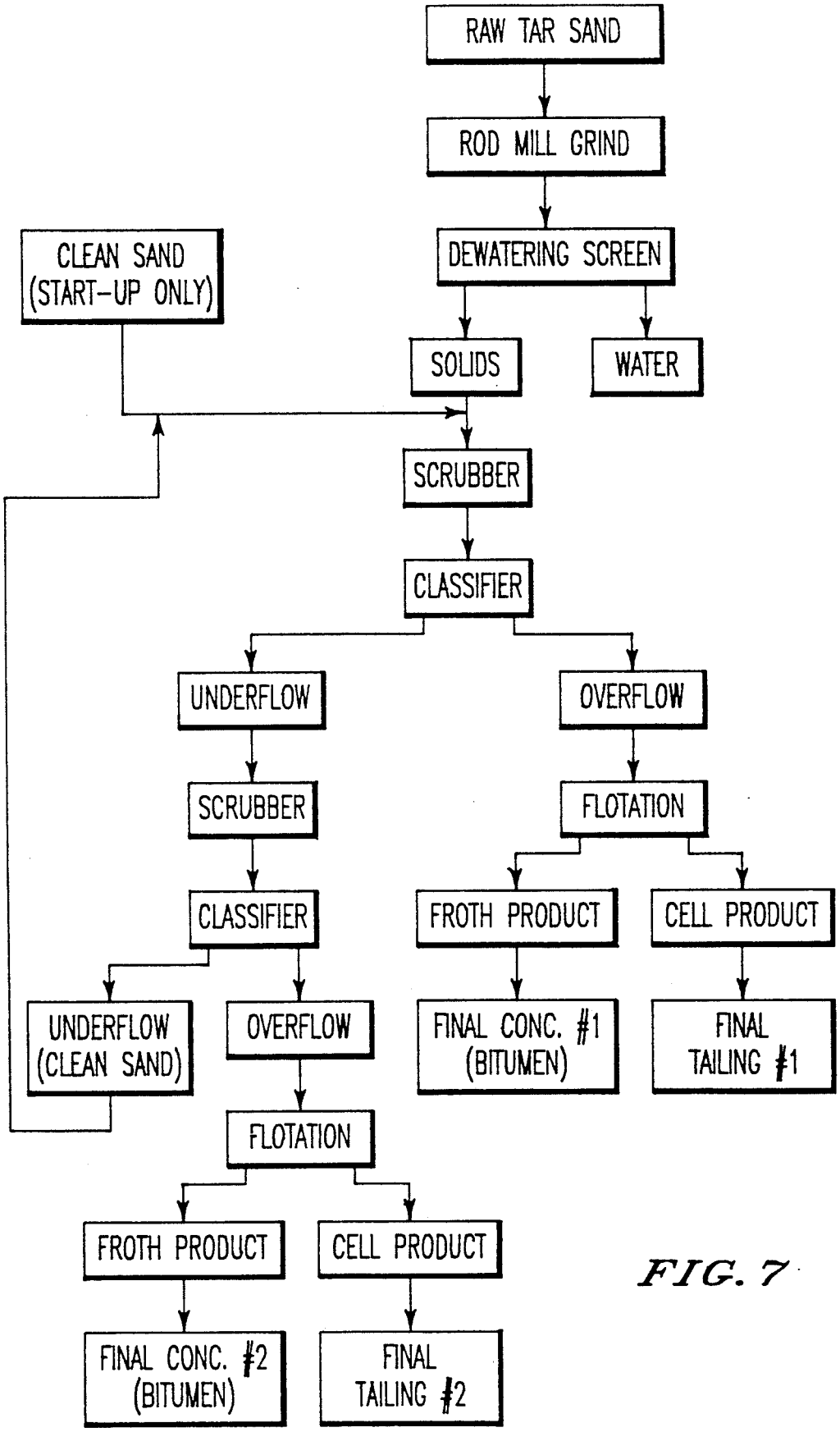
FIG. 7 represents a two stage bitumen recovery flow sheet for an embodiment in accordance with the present invention.

The tailing from flotation was screened to reclaim the coarse Ottawa sand. All products from the process, as shown in FIG. 6, were analyzed by the Dean-Starke extraction procedure.

The Tables 1 and 2 represent the results of the application of this process to Spring Creek and Asphalt Ridge (Utah) tar sands.

TABLE 1

| Beneficiation of Spring Creek Tar Sand | | |
|---|---|---|
| Product | % Bitumen | Bitumen Distribution |
| Conc | 46.2 | 86.8 |
| Tailing | 0 | 0 |
| Slimes | 1.9 | |
| "Sink" | 0 | 13.2 |
| Feed | 6.7 | 100 |

TABLE 2

| Beneficiation of Asphalt Ridge Tar Sand | | |
|---|---|---|
| Product | % Bitumen | Bitumen Distribution |
| Conc. | 53.4 | 37.1 |
| Tailing | 3.2 | 6.2 |
| Slimes | 22.3 | 50.6 |
| "Sink" | 4.9 | 6.1 |
| Feed | 16.3 | 100 |

From the results displayed in Tables 1 and 2, it may be seen that the use of coarse sand from an external source is highly effective in achieving disengagement of bitumen from matrix sand grains. Thus, in accordance with the present invention, a high quality concentrate may be obtained by a physical, ambient-temperature process.

Having described the present invention, it will now be apparent to one of ordinary skill in the art that many changes and modifications can be made to the above-described embodiments without departing from the spirit and the scope of the present invention.

What is claimed as new and desired to be secured by Letters Patent of the United States is;

1. A process for separating bitumen from tar sands, which comprises:

a) agitating a mixture of said tar sand with substantially coarse clean sand at ambient or below ambient temperature in the presence of water, so as to mechanically shear bitumen and enhance the detachment of bitumen particles from mineral matter in said tar sand, b) eluting the detached bitumen and fine mineral matter from the coarse sand by an upward flow of water while stirring gently, c) returning the coarse sand to step a) for reuse, and subjecting the eluted bitumen and fine mineral matter to froth flotation to separate the bitumen from said fine mineral matter, wherein the flotation is effected without using any reagents.

2. The process of claim 1, which further comprises breaking said tar sand to a size distribution approximating that of the mineral matter contained in said tar sand prior to agitating said mixture of tar sand, substantially clean sand and water.

3. The process of claim 1, wherein the amount of substantially clean sand used is in excess of the amount of tar sand used.

4. The process of claim 1, wherein the mixture is agitated for several minutes at a high ratio of solids to water and a high rate of shear.

5. The process of claim 1, which further comprises adding a dispersant to the mixture prior to agitation.

6. The process of claim 1, wherein after agitation, the mixture is diluted with water to a solids concentration of about 5 to 10% by weight.

7. The process of claim 5, wherein said dispersant is sodium silicate or sodium hydroxide or both.

8. The process of claim 1, wherein said substantially clean sand is at least about 95% by weight $SiO_2$.

9. The process of claim 1, wherein said substantially clean sand has a grain size of about $-25+60$ mesh.

10. The process of claim 1, which further comprises cooling said mixture of tar sand, substantially clean sand and water during agitation.

* * * * *

UNITED STATES PATENT AND TRADEMARK OFFICE

CERTIFICATE OF CORRECTION

PATENT NO. : 5,186,820

DATED : February 16, 1993

INVENTOR(S) : Clifford W. Schultz, et al.

It is certified that error appears in the above-identified patent and that said Letters Patent is hereby corrected as shown below:

In the Abstract, line 3, change "coarse clean" to --clean course--.

Column 2, line 52, change "clean" to --coarse clean--.

Column 3, line 41, delete "a" (first occurerence).

Column 5, line 41, change "ar" to --are--.

Column 8, line 13, change "coarse clean" to --clean course--.

Signed and Sealed this

Twenty-second Day of March, 1994

*Attest:*

*Attesting Officer*

BRUCE LEHMAN

*Commissioner of Patents and Trademarks*